United States Patent [19]

Yoshida et al.

[11] Patent Number: 4,804,356

[45] Date of Patent: Feb. 14, 1989

[54] APPARATUS FOR PROCESSING BAGLIKE CONTAINER BLANKS

[75] Inventors: Kiyomi Yoshida; Fumiyuki Iwano; Kojiro Hayashi, all of Tokushima, Japan

[73] Assignee: Shikoku Kakoki Co., Ltd., Tokushima, Japan

[21] Appl. No.: 170,199

[22] Filed: Mar. 18, 1988

[30] Foreign Application Priority Data

Mar. 20, 1987 [JP] Japan ..... 62-67581

[51] Int. Cl.[4] ..... B31B 1/64

[52] U.S. Cl. ..... 493/206; 493/133; 493/164; 493/183; 493/247; 493/261; 493/474

[58] Field of Search ..... 493/127, 133, 134, 164, 493/165, 183, 184, 141, 474, 453, 192, 206, 246, 247, 248, 252, 253, 260, 261, 308, 254, 196, 201; 53/378

[56] References Cited

U.S. PATENT DOCUMENTS 2,245,675 6/1941 Holtin ..... 493/254

2,381,850 8/1945 Williams ..... 493/474

*Primary Examiner*—Frederick R. Schmidt

*Assistant Examiner*—Robert Showalter

*Attorney, Agent, or Firm*—Armstrong, Nikaido, Marmelstein & Kubovcik

[57] ABSTRACT

An apparatus for processing baglike container blanks by fitting the blank around a pair of forming plates arranged at a distance from each other in parallel, folding a pair of triangular ears flat while projecting the ears sidewise from the portion of the blank to be made into the bottom of a finished rectangular parallelepipidal container, and press-bonding the projected ears to outer surface portions of the trunk of the container at the lateral sides thereof after folding the ears over the outer surface portions. The apparatus includes a device for press-bonding the triangular ears, which comprises a pair of press members and a support member positionable therebetween. Each lateral side trunk portion and each ear folded thereover are clamped between the support member and the press member respectively from inside and outside the blank.

4 Claims, 6 Drawing Sheets

APPARATUS FOR PROCESSING BAGLIKE CONTAINER BLANKS

BACKGROUND OF THE INVENTION

The present invention relates to an apparatus for processing baglike container blanks for use in a packaging machine for producing rectangular parallelepipedal containers filled with milk or like contents.

Apparatus of this type heretofore known include one which is adapted to process baglike container blanks each having a thermoplastic synthetic resin layer on each of its opposite surfaces by folding a pair of triangular ears flat while projecting the ears sidewise from the portion of each blank to be made into the bottom of a finished rectangular parallelepipedal container, and press-bonding the projected triangular ears to outer surface portions of the trunk wall of the container at the lateral sides thereof after folding the ears over the lateral side portions.

With reference to FIG. 8, each triangular ear E is press-bonded to the lateral side portion by fitting the container blank B around a pair of forming plates 11, 12 arranged at a distance from each other in parallel, and then pressing a press bonding member 13 against the ear E. The lateral side portion over which the ear E is folded is therefore subjected to the pressure and becomes damaged. Especially because this portion has a sealed seam S produced when the blank B is formed, the base portion of the seam S indicated by an arrow is liable to damage locally, with the resulting likelihood that a polyethylene layer forming the blank B will break to develop a pinhole at the base portion.

SUMMARY OF THE INVENTION

The main object of the present invention is to provide an apparatus for processing baglike container blanks free of the above problem.

The present invention provides an apparatus for processing baglike container blanks each having a thermoplastic synthetic resin layer on each of its opposite surfaces by folding a pair of triangular ears flat while projecting the ears sidewise from the portion of each blank to be made into the bottom of a finished rectangular parallelepipidal container, and press-bonding the projected triangular ears to outer surface portions of the trunk wall of the container at the lateral sides thereof after folding the ears over the outer surface portions. The apparatus comprises an apparatus frame having a plurality of stations arranged along a circumference at equal spacings, one of the stations being a press bonding station; a horizontal rotary drum intermittently drivingly movable and having stationary forming plates and movable forming plates, the stationary forming plates being arranged at equal spacings and identical in number to the number of the stations, the movable forming plates being opposed to the respective stationary forming plates in pairs each stoppable at each of the stations while traveling from station to station, the stationary and movable forming plates having a width equal to the spacing between the inner surfaces of lateral sides of the container trunk wall, each of the movable forming plates being pivotally movable to a position where the opposed plates in each pair are closed to a wedgelike form with their forward ends in contact with each other or to a position where the opposed forming plates are open and parallel to each other with their outer surfaces spaced apart by a distance equal to the spacing between the inner surfaces of the front and rear sides of the container trunk wall; and a press bonding device disposed at the press bonding station for press-bonding the folded triangular ears to the outer surface portions of the trunk wall of the container at the lateral sides thereof, the press bonding device comprising a pair of press members and a support member, the press members being opposed to each other and arranged at opposite sides of the path of travel of the forming plates so as to be opposed to the respective triangular ears of the blank as fitted around the pair of forming plates at rest at the press bonding station, the press members being horizontally movable toward or away from each other with the blank positioned therebetween, the support member being positionable between the pair of forming plates as opened when seen sidewise so as to be pressed on by each of the press members with the lateral side trunk wall portion and the triangular ear interposed therebetween when the press members are moved toward each other.

According to the present invention, each of the press members is pressed against the support member with the triangular ear and the lateral side trunk wall portion of the blank interposed therebetween for the support member to withstand the pressure of the press member. Unlike the conventional apparatus, this obviates the likelihood that the pressure will cause damage to the lateral side portion over which the ear is folded.

BRIEF DESCRIPTION OF THE DRAWINGS

FIG. 1 is a view in vertical section;

FIG. 2 is a side elevation showing a pair of forming plates in closed state;

FIG. 3 is a view in section taken along the line III—III in FIG. 1;

FIG. 4 is an exploded perspective view of the forming plates and a support member;

DESCRIPTION OF THE PREFERRED EMBODIMENT

An embodiment of the invention will be described below with reference to FIGS. 1 to 7.

Figure 6:
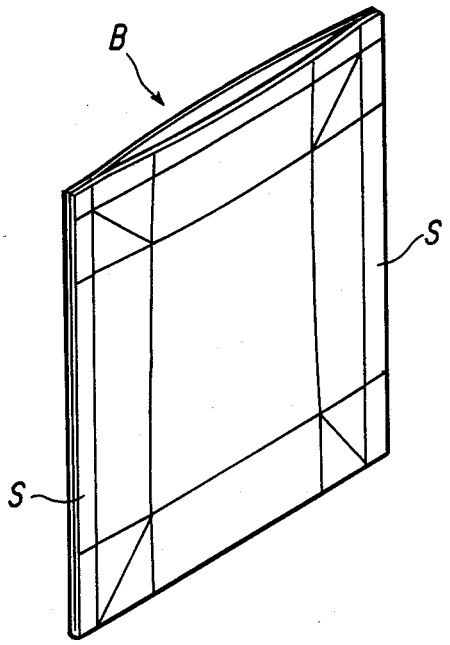
FIG. 6 is a perspective view showing a container blank before processing.
Figure 7:
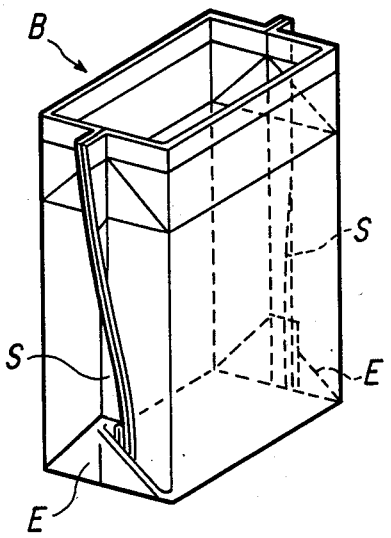
FIG. 7 is a perspective view showing the container as processed.
Figure 8:
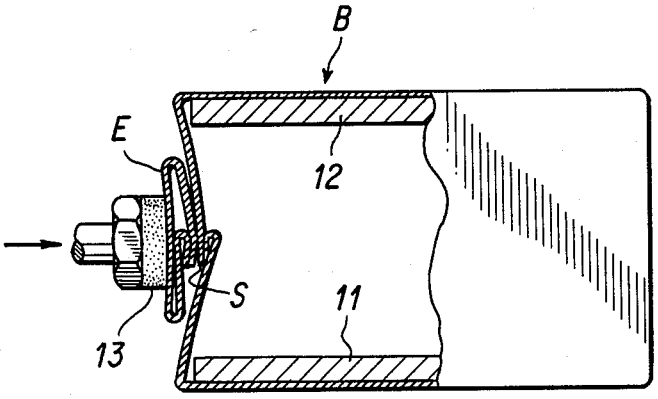
FIG. 8 PRIOR ART
FIG. 8 is a diagram for illustrating a conventional apparatus.

Before describing the apparatus, the container blank B to be processed thereby will be described. With reference to FIG. 6, the blank B is prepared from a paper-base sheet having a polyethylene layer on each surface thereof, by folding the sheet in two to form three lapped side edge portions and forming a sealed seam S at each of the two parallel lapped edge portions to obtain a bag. As shown in FIG. 7, the bottom portion of the blank B is so bent that a pair of triangular ears E are folded flat while causing the ears to project sidewise from the portion of the blank to be made into the bottom of a finished container, and the projected triangular ears E are folded over and bonded to the first opposed sidewalls of the container.

Figure 5:
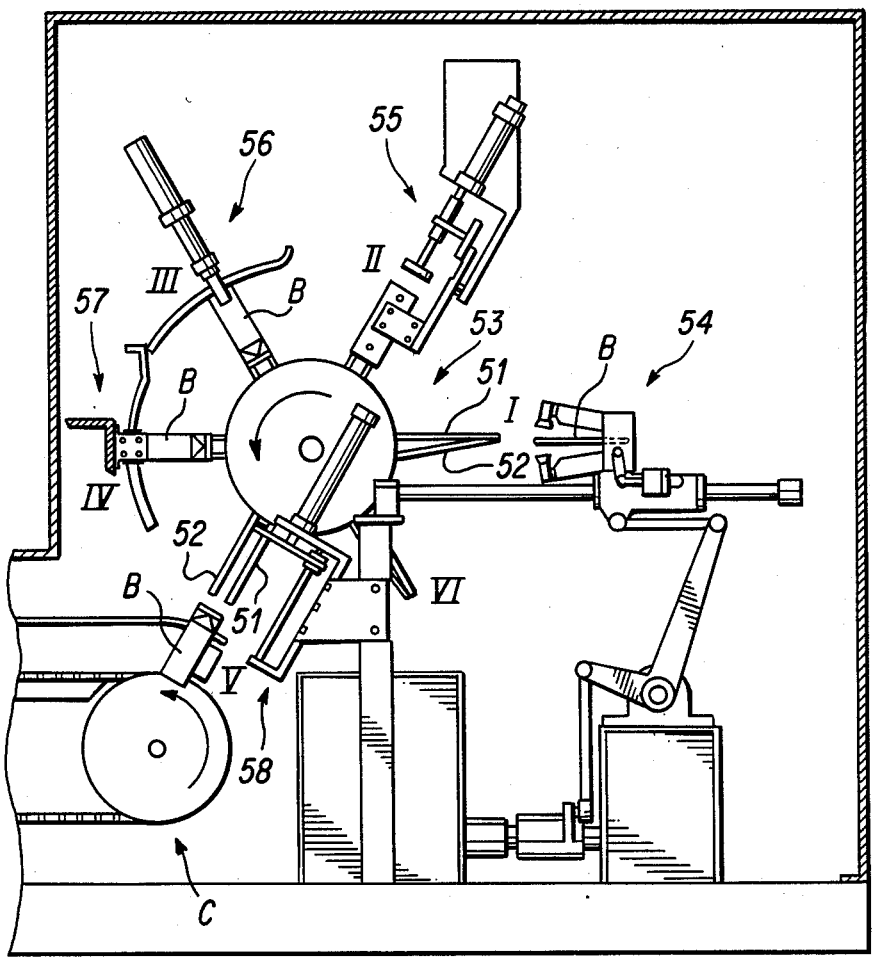
FIG. 5 is a side elevation showing the apparatus in its entirety.

With reference to FIG. 5, the processing apparatus comprises an apparatus frame disposed above the starting end of a path of transport by a container conveyor C and having six stations, i.e., feeding, folding, heating, press bonding, transfer and idling stations I to VI which are arranged along a circumference at equal spacings. The apparatus further comprises a horizontal rotary drum 53 intermittently drivingly movable and having six radial stationary forming plates 51 and six radial movable forming plates 52 opposed to the respective plates 51 in pairs. Each pair of forming plates 51 and 52 stops at each of the six processing stations I to VI while traveling from station to station.

At the feeding station I, each of the movable forming plates 52 is pivotally movable by unillustrated means to a position where the opposed forming plates 51, 52 in each pair are closed to a wedgelike form with their forward ends in contact with each other, while at the other stations II to VI, each movable forming plate 52 is similarly movable to a position where the opposed forming plates 51, 52 are open and parallel to each other.

The feeding station I is provided with a feeder 54 by which the blank B folded flat has its open end opened and fitted around the forming plates 51, 52 at rest at the station I. The folding station II is provided with a folding unit 55 for folding the bottom portion of the blank B fitted around the pair of forming plates 51, 52 while causing a pair of triangular ears E to project from the portion to be made into the bottom of a finished container. The heating station III is provided with a heater 56 for heating the projected ears E from the rear. Extending from the heating station III to the press bonding station IV is a bending guide 15 for bending the pair of heated triangular ears E over outer surface portions of the trunk wall of the container at the lateral sides thereof. The press bonding station IV is provided with a press bonding device 57 for press-bonding the bent ears E to the lateral side portions of the trunk wall. At the transfer station V, a transfer unit 58 is disposed by which the processed blank B is removed from the pair of forming plates and transferred onto the conveyor C so as to be sent to the subsequent process.

Figure 1:
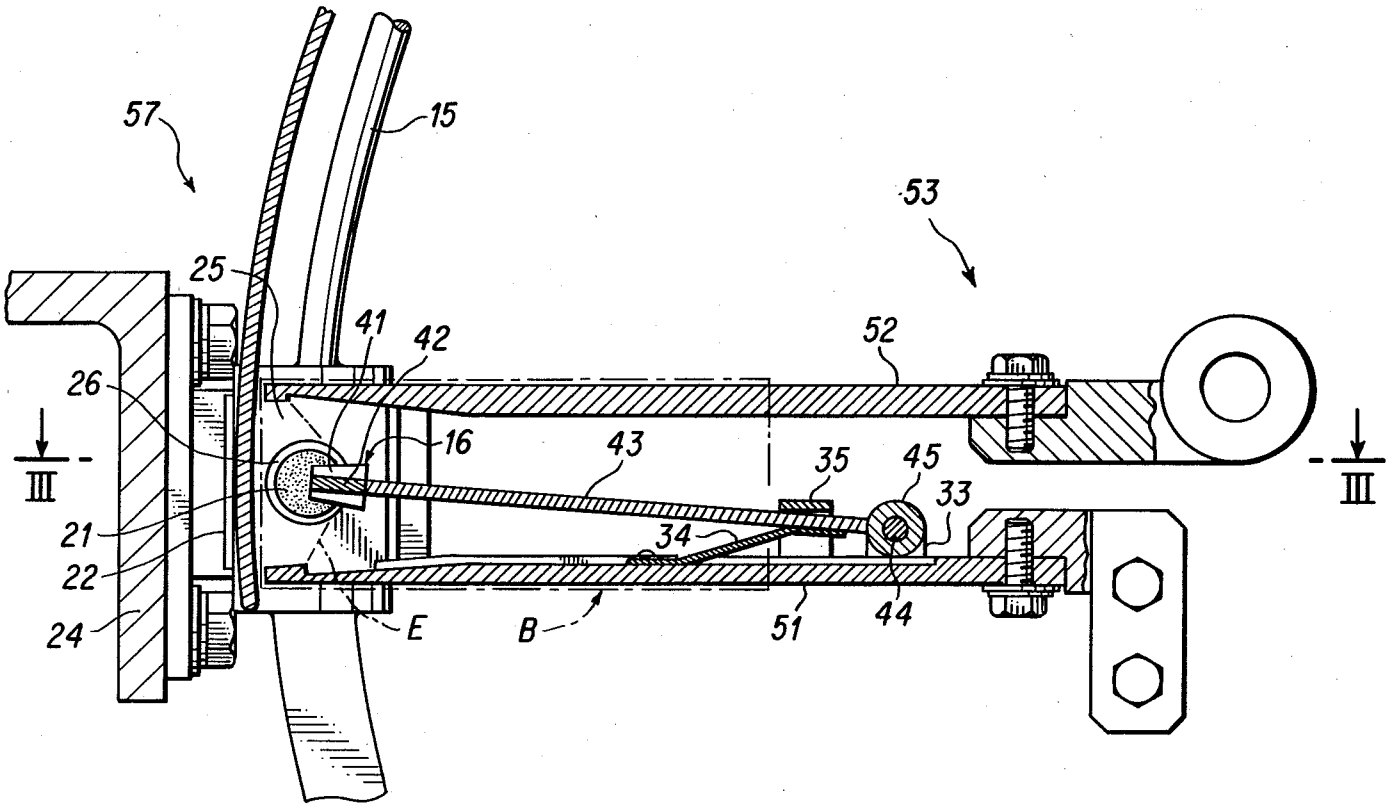
FIGS. 1 to 4 are fragmentary views showing an apparatus of the invention.

FIG. 1 shows the ear press bonding device 57 and the pair of stationary and movable forming plates 51, 52 at rest at the press bonding station IV. A support member 16 is disposed between the forming plates 51, 52.

The ear press bonding device 57 comprises a pair of press members 21 of elastic material opposed to each other and arranged at opposite sides of the path of travel of the opposed forming plates 51, 52. Each of the press members 21 is attached to the piston rod 23 of a hydraulic cylinder 22. The hydraulic cylinder 22 is horizontally disposed at the other side of the press member 21 opposite to the side thereof facing the path of travel and is attached to the apparatus frame 24.

The ear bending guide 15 extends to a position close to the press bonding device 57 and is in the form of a round bar over its entire width. The guide 15 is provided at its terminal end with a pair of rectangular flat guide plates 25, with the press member 21 inserted in a hole 26 formed in each plate 25.

The stationary and movable forming plates 51, 52 are generally identical with each other in configuration and rectangular, and have a width equal to the spacing between the inner surfaces of the second opposed sidewalls of the container as finished. When the plates 51, 52 are opened, their outer surfaces are spaced apart by a distance equal to the spacing between the inner surfaces of the first opposed sidewalls of the container. Although not described in detail, the forming plates 51, 52 are supported at their base ends on the rotary drum 53 by suitable means, while the movable forming plate 52 is movable by known means, such as a cam mechanism. The forming plates 51, 52 have cutouts 31, 32, respectively, formed in their opposite side edges and positioned close to their forward ends. The stationary forming plate 52 is formed on its inner surface with a pair of projections 33 opposed to each other and positioned close to its base end. The plate 52 has a plate spring 34 screwed to the inner surface and positioned closer to its forward end than the projections 33, and a gatelike stopper 35 provided over the spring 34 and bolted to the inner surface at opposite sides of the spring.

The support member 16 comprises a pair of trapezoidal support pieces 41 and a connecting piece 42 in the form of a rectangular flat plate and interconnectign the support pieces 41. A pivotal arm 43 is joined at its forward end to the connecting piece 42 at the midportion of its length. The pivotal arm 43 has at its base end a support rod 45 which is rotatably supported by bolts 44 each extending through the projection 33 into the rod. The arm 43 is held at a position close to its base end between the free end of the plate spring 34 and the stopper 35.

Figure 2:
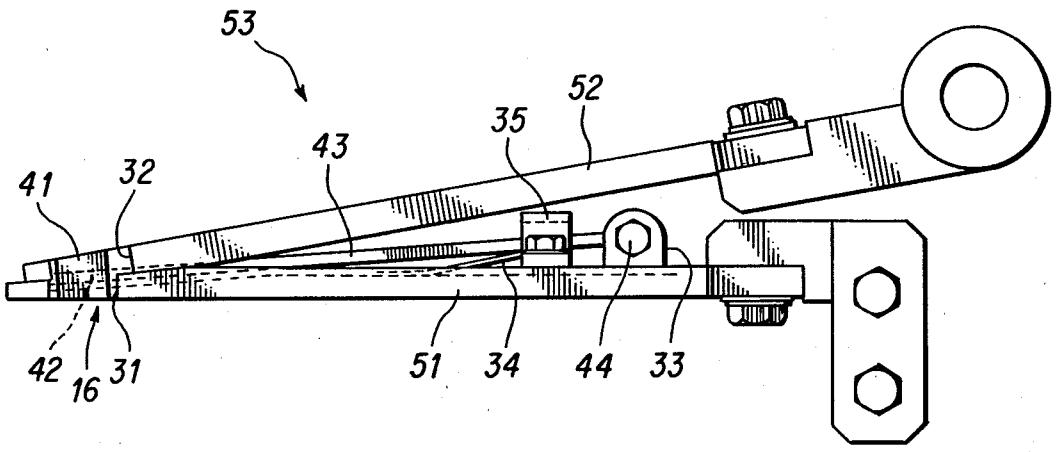
Figure 3:
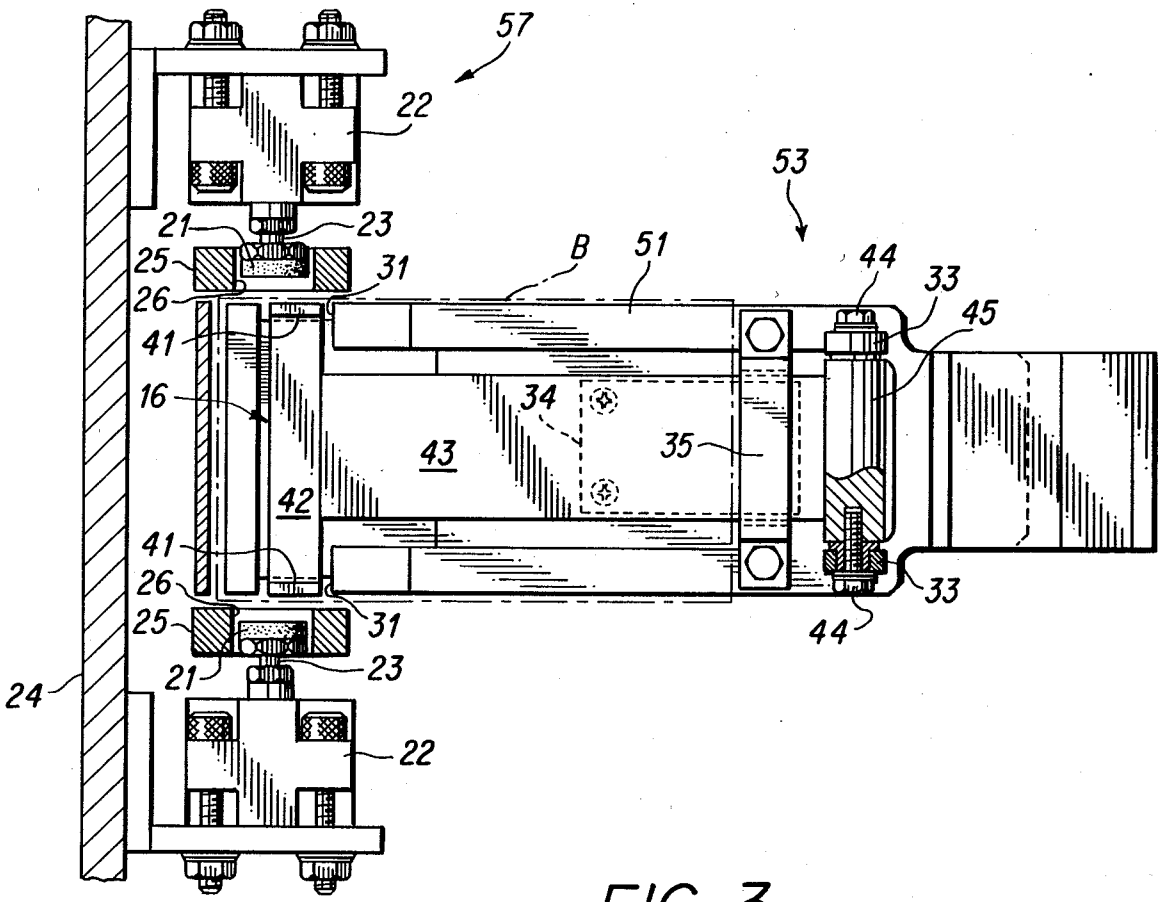
Figure 4:
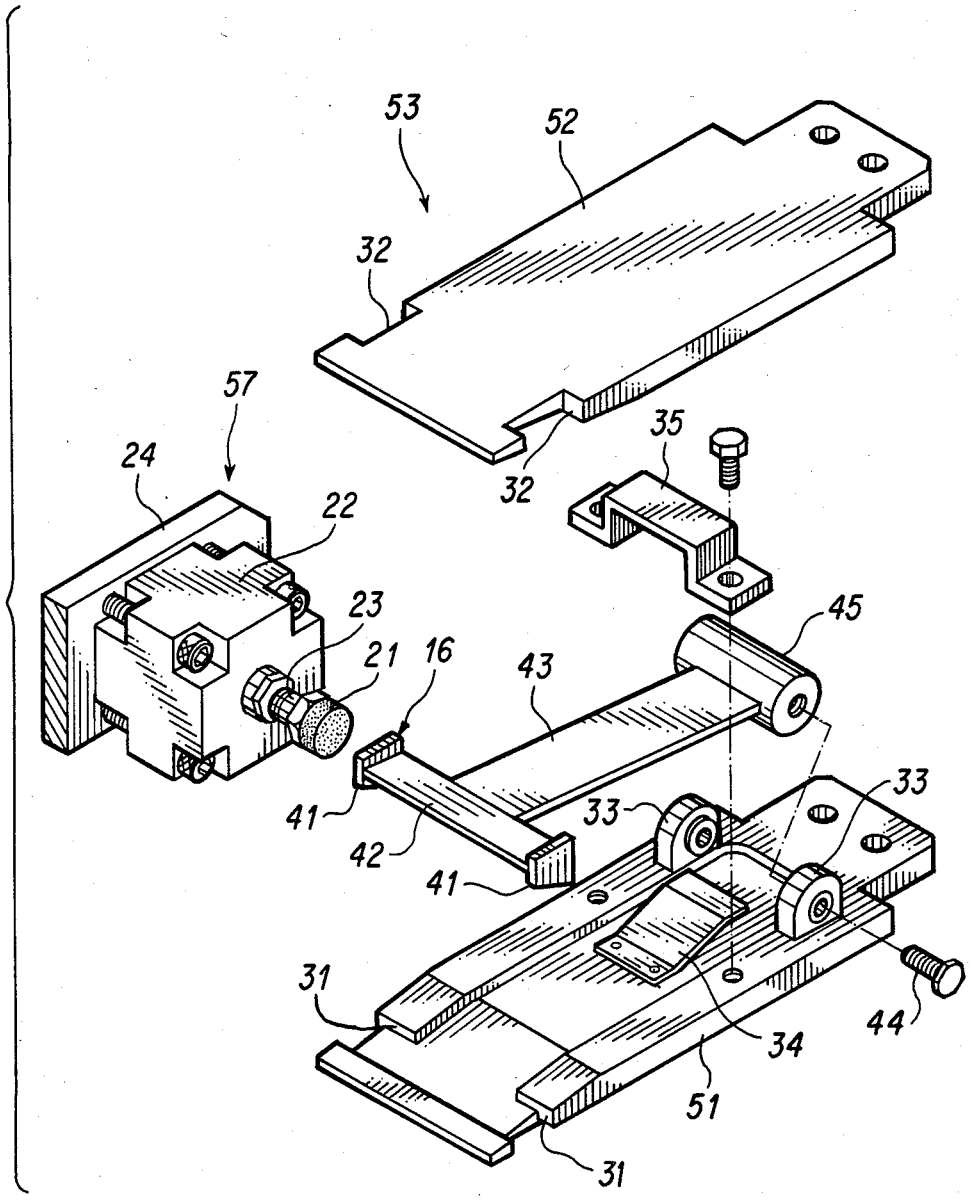

With the forming plates 51, 52 in the open state, the arm 43 is held in contact with the stopper 35 by the action of the plate spring 34, holding the two support pieces 41 opposed to the respective press members 21. The movable forming member 52, when moved from this state toward the stationary plate 51, causes its forward end to push the connecting piece 42 of the support member 16, thereby moving the support member 16 toward the stationary forming plate 51 against the action of the plate spring 34. When the forming plates 51, 52 are completely closed, the two support pieces 41 are accommodated in the cutouts 31, 32 of the forming plates 51, 52 as seen in FIG. 2.

When the triangular ears E are to be press bonded, the two forming plates 51, 52 are held open with the two support pieces 41 opposed to the respective press members 21. When the press members 21 are brought toward each other by the operation of the hydraulic cylinders 22, the lateral side trunk wall portion and each triangular ear E folded thereover are pressed against the support piece 41 of the support member 16 by each of the press members 21.

What is claimed is:

1. An apparatus for processing baglike container blanks each having a thermoplastic synthetic resin layer on each of its opposite surfaces by folding a pair of triangular ears flat while projecting the ears sidewise from the portion of each blank to be made into the bottom of a finished rectangular parallelepided container having first and second pairs of opposed side walls, and press-bonding the projected triangular ears to outer surface portions of the first opposed sidewalls of the container after folding the ears over the outer surface portions, the apparatus comprising:

an apparatus frame having a plurality of stations arranged along a circumference at equal spacings, one of the stations being a press bonding station, a horizontal rotary drum intermittently drivingly movable and having stationary forming plates and movable forming plates, the stationary forming plates being arranged radially at equal spacings and identical in number to the number of the stations, the movable forming plates being opposed to the respective stationary forming plates in pairs each stoppable at each of the stations while traveling from station to station, the stationary and movable forming plates having a width equal to the spacing between the inner surfaces of the second opposed side walls of the container, each of the movable forming plates being pivotally movable to a position where the opposed plates in each pair are closed to a wedgelike form with their forward ends in contact with each other and to a position where the opposed forming plates are open and parallel to each other with their surfaces spaced apart by a distance equal to the spacing between the inner surfaces of the first opposed side walls of the container, and a press bonding device disposed at the press bonding station for press-bonding the folded triangular ears to said outer surface portions of the first opposed side walls of the container, the press bonding device comprising a pair of press members and a support member, the press members being opposed to each other and arranged at opposite sides of the path of travel of the forming plates so as to be opposed to the respective triangular ears of the blank as fitted around the pair of forming plates at rest at the press bonding station, the press members being horizontally movable toward and away from each other with the blank positioned therebetween, the support member being positioned between the pair of forming plates as opened when seen sidewise so as to be pressed on by each of the press members with one of said first opposed side wall portions and one of said triangular ears interposed between one of said press members and one side of said support member when the press members are moved toward each other.

2. An apparatus as defined in claim 1 wherein the rotary drum is provided with means for moving the support member between an operative position where the support member is positioned between the pair of press members in the press bonding station with the pair of forming plates opened, and a stowed position where the support member is held out of interference with the pair of forming plates in their closed state.

3. An apparatus as defined in claim 1 wherein each of the press members is attached to the piston rod of a hydraulic cylinder, the hydraulic cylinder being disposed horizontally at one side of the press member opposite to the other side thereof facing the path of travel of the forming plates and being attached to the apparatus frame, each of the pair of forming plates having a cutout formed in each of its opposite side edges close to the forward end thereof and positionable in opposed relation to one of said first opposed side wall portions and the respective triangular ear folded thereover, the support member comprising a pair of support pieces each having a vertical pressure withstanding face flush with the corresponding side faces of the pair of forming plates, each of the support pieces being positionable in the cutouts in the pair of forming plates at the corresponding side thereof when the forming plates are close to each other, the support member further comprising a connecting piece interconnecting the pair of support pieces, the connecting piece being positionable in a clearance formed between the pair of forming plates as positioned close to each other, an arm being joined at its forward end to the connecting piece at the midportion of its length, the arm being disposed between the pair of forming plates and supported at its base end on the inner surface of the stationary forming plate at a position close to the base end thereof so as to be pivotally movable about an axis in parallel to the axis of the rotary drum, a plate spring being attached to the inner surface of the stationary forming plate and positioned between the opposite ends thereof for biasing the arm toward the movable forming plate, a gatelike stopper being provided over the arm and attached to the stationary forming plate at opposite sides of the plate spring, the arm being in contact with the stopper when the pair of forming plates are in their open state to hold the support member in an operative position where the pair of support pieces are opposed to the pair of the pressed members respectively at the press bonding station, the support member being holdable in a stowed position where the pair of support pieces are accommodated in the cutouts by the movable forming plate against the plate spring when the pair of forming plates are in their closed state.

4. An apparatus for processing baglike container blanks each having a thermoplastic synthetic resin layer on each of its opposite surfaces, comprising:

an apparatus frame having feeding, folding, heating, press bonding, transfer and idling six stations arranged along a circumference at equal spacings, a horizontal rotary drum intermittently drivingly movable and having six stationary forming plates in a radial arrangement at equal spacings and six movable forming plates opposed to the respective stationary forming plates in pairs each stoppable at each of the stations while traveling from station to station, the stationary and movable forming plates having a width equal to the spacing between the inner surfaces of second opposed side walls of the container to be completed, each of the movable forming plates being pivotally movable so that the pair of forming plates are closed to a wedgelike form at the feeding station with their forward ends in contact with each other, and are opened to position in parallel to each other at the other stations, the pair of forming plates, when open, having their outer surfaces spaced apart by a distance equal to the spacing between the inner surfaces of first opposed side walls of the container, a feeder provided at the feeding station for opening an open end of the blank as folded flat and fitting the blank around the pair of forming plates at rest at the feeding station, a folding unit provided at the folding station for folding the bottom portion of the blank fitted around the pair of forming plates while causing a pair of triangular ears to project from the portion to be made into the bottom of the container to be completed, a heater provided at the heating station for heating the projected triangular ears from the rear side, a bending guide extending from the heating station to the press bonding station for bending the pair of heated triangular ears over outer surface portions of the first opposed side walls of the container, and a press bonding device provided at the press bonding station for press-bonding the bent triangular ears to the first opposed sidewall portions, the press bonding device comprising a pair of press members and a support member, the press members being opposed to each other and arranged at opposite sides of the path of travel of the forming plates so as to be opposed to the respective triangular ears of the blank as fitted around the pair of forming plates at rest at the press bonding station, the pair of press members being attached to the piston rods of a pair of hydraulic cylinders respectively so as to be movable toward and away from each other with the blank positioned therebetween, each of the hydraulic cylinders being disposed horizontally at one side of the press member opposite to the other side thereof facing the path of travel of the forming plates and attached to the apparatus frame, the support member being positionable between the pair of forming plates as opened when seen sidewise so as to be pressed against by each of the press members with one of said first opposed side wall portions and one of said triangular ears interposed therebetween when the press members are moved toward each other, each of the pair of forming plates having a cutout formed in each of its opposite side edges close to the forward end thereof and positionable in opposed relation to one of said first side wall portions and the respective triangular ear folded thereover, the support member comprising a pair of support pieces each having a vertical pressure withstanding face flush with the corresponding side faces of the pair of forming plates, each of the support pieces being positionable in the cutouts in the pair of forming plates at the corresponding side thereof when the forming plates are close to each other, the support member further comprising a connecting piece interconnecting the pair of support pieces, the connecting piece being positionable in a clearance formed between the pair of forming plates as positioned close to each other, an arm being joined at its forward end to the connecting piece at the midportion of its length, the arm being disposed between the pair of forming plates and supported at its base end on the inner surface of the stationary forming plate at a position close to the base end thereof so as to be pivotally movable about an axis in parallel to the axis of the rotary drum, a plate spring being attached to the inner surface of the stationary forming plate and positioned between the opposite ends thereof for biasing the arm toward the movable forming plate, a gatelike stopper being provided over the arm and attached to the stationary forming plate at opposite sides of the plate spring, the arm being in contact with the stopper when the pair of forming plates are in the open state to hold the support member in an operative position where the pair of support pieces are opposed to the pair of the press members respectively at the press bonding station, the support member being holdable in a stowed position where the pair of support pieces are accommodated in the cutouts by the movable forming plate against the plate spring when the pair of forming plates are in the closed state.

* * * * *